US005860477A

United States Patent [19]

Wilson et al.

[11] Patent Number: 5,860,477

[45] Date of Patent: Jan. 19, 1999

[54] UNDERWATER OIL FIELD APPARATUS

[75] Inventors: James Brian Wilson, Bristol; David William Pearce, Clevedon, both of United Kingdom

[73] Assignee: GEC-Marconi Limited, Middlesex, United Kingdom

[21] Appl. No.: 761,872

[22] Filed: Dec. 9, 1996

[30] Foreign Application Priority Data

Dec. 23, 1995 [GB] United Kingdom ..... 9526513

[51] Int. Cl.[6] ..... E21B 43/00

[52] U.S. Cl. ..... 166/343; 166/349

[58] Field of Search ..... 166/368, 341, 166/343, 349

[56] References Cited

U.S. PATENT DOCUMENTS 3,050,139 8/1962 Hayes .
3,071,188 1/1963 Raulins .
3,452,815 7/1969 Watkins .
5,310,006 5/1994 Freitas et al. ..... 166/349 X

FOREIGN PATENT DOCUMENTS 2 209 550 5/1989 United Kingdom .
2 264 737 9/1993 United Kingdom .

*Primary Examiner*—William Neuder
*Attorney, Agent, or Firm*—Venable; Robert J. Frank; Michael A. Sartori

[57] ABSTRACT

A latching mechanism for a sub-sea control module is constructed with energy storing means such that a latch is cooked into an unlatched condition by the action of lifting the sub-sea control module to store energy in the energy storing means and is moved into a latched condition by the action of lowering the sub-sea control module into abutment with the mounting base.

20 Claims, 8 Drawing Sheets

UNDERWATER OIL FIELD APPARATUS

FIELD OF THE INVENTION

The present invention relates to an underwater oil field apparatus and more particularly to the latching of and unlatching of the so-called pod control units to a sub-sea mounting base.

BACKGROUND OF THE INVENTION

For an underwater oil well to become operational it is necessary to install at the well-head an assembly known as a "Christmas Tree" which combines equipment for monitoring and controlling the output flow from the well.

The Christmas Tree fitted to the well-head comprises, in particular, a large number of hydraulically actuated valves, the remote control of which is effected from a general operating station on the surface.

In particular, this operating station can be located on an oil rig which is connected to one or more underwater stations each by an umbilical cord providing the means for conveying electrical and/or hydraulic energy and the transmission of electrical or optical signals for controlling the oil extraction. The operating station may also be shore based.

Each underwater station may comprise one or more well-heads.

The operating station on the surface thus enables the remote control of a very large number of valves.

Each of the hydraulically actuated valves is of the type comprising a hydraulic valve actuator which is connected to a supply of pressurized fluid via a control unit, comprising a control valve for the flow of pressurized fluid and means for connecting the unit to the supply of pressurized fluid and to the network for transmission of control signals of the valve.

According to a known arrangement, the control of the operation of the assembly of hydraulically actuated valves of a Christmas Tree of one well-head is effected by a control unit secured to the well-head and which is connected to the hydraulic valve actuators by flexible pipes.

This control unit, which is known as a Sub-sea Control Module (SCM) or "POD", is a heavy and expensive apparatus which is specific to the configuration of a well-head.

Typically, such a unit is lowered onto the sub-sea installation using special Remotely Operated Vehicles (ROVs) and Remotely Operated Tooling (ROTs) from floating work barges or service vessels using soft landing guide wires and latching pins located on the sub-sea well installation. The weight of the control unit is typically 1.5 tons or more and requires substantial framing and counterweights on the installation to balance the loads on the well-head Christmas Tree.

The present invention is concerned with the mechanism used to releasably latch the so-called sub-sea control module, or pod to the Christmas Tree.

In a known arrangement this latching mechanism comprises a screw driven bolt-like member having a star-shaped lower end adapted to engage in a complementary shaped aperture in a pod mounting base carried by the Christmas Tree. Such a device is known as a retlock, is relatively expensive to manufacture and requires motive power to drive the rotatable screw in order to move it into and out of the locking or latching condition.

The present invention is concerned with simplifying and reducing the cost of this type of latching mechanism and making it more rapidly acting.

SUMMARY OF THE INVENTION

According to the present invention a latching mechanism of the kind described is constructed with energy storing means such that the latch is cocked into an unlatched condition by the action of lifting the sub-sea control module to store energy in the energy storing means and is moved into a latched condition by the action of lowering the sub-sea control module into abutment with the mounting base and releasing the stored energy, without the need for hydraulic or mechanical actuation.

In a preferred embodiment of the invention the energy storing means comprises a spring or springs.

BRIEF DESCRIPTION OF THE DRAWINGS

How the invention may be carried out will now be described, by way of example only, with reference to the accompanying drawings in which.

DETAILED DESCRIPTION OF THE INVENTION

Figure 1:
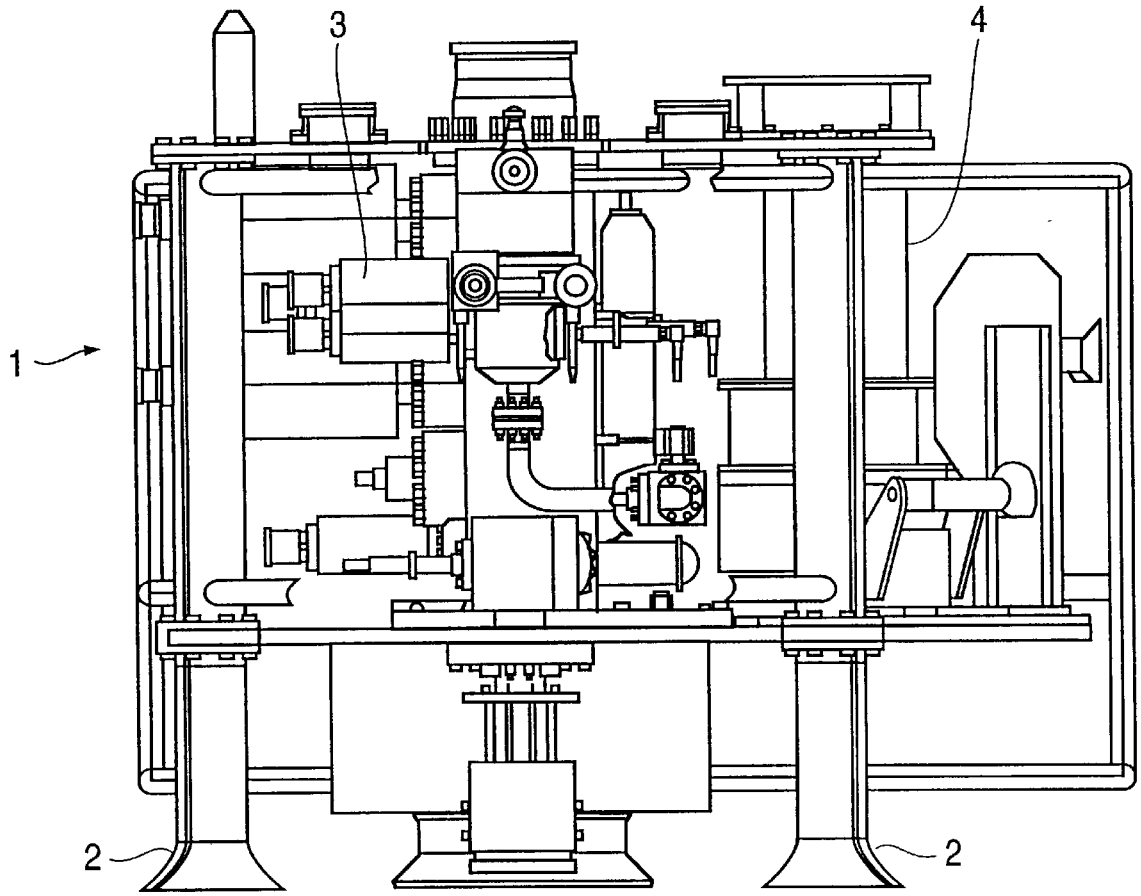
FIG. 1 is a side elevational view of a Christmas Tree incorporating an SCM.
Figure 2:
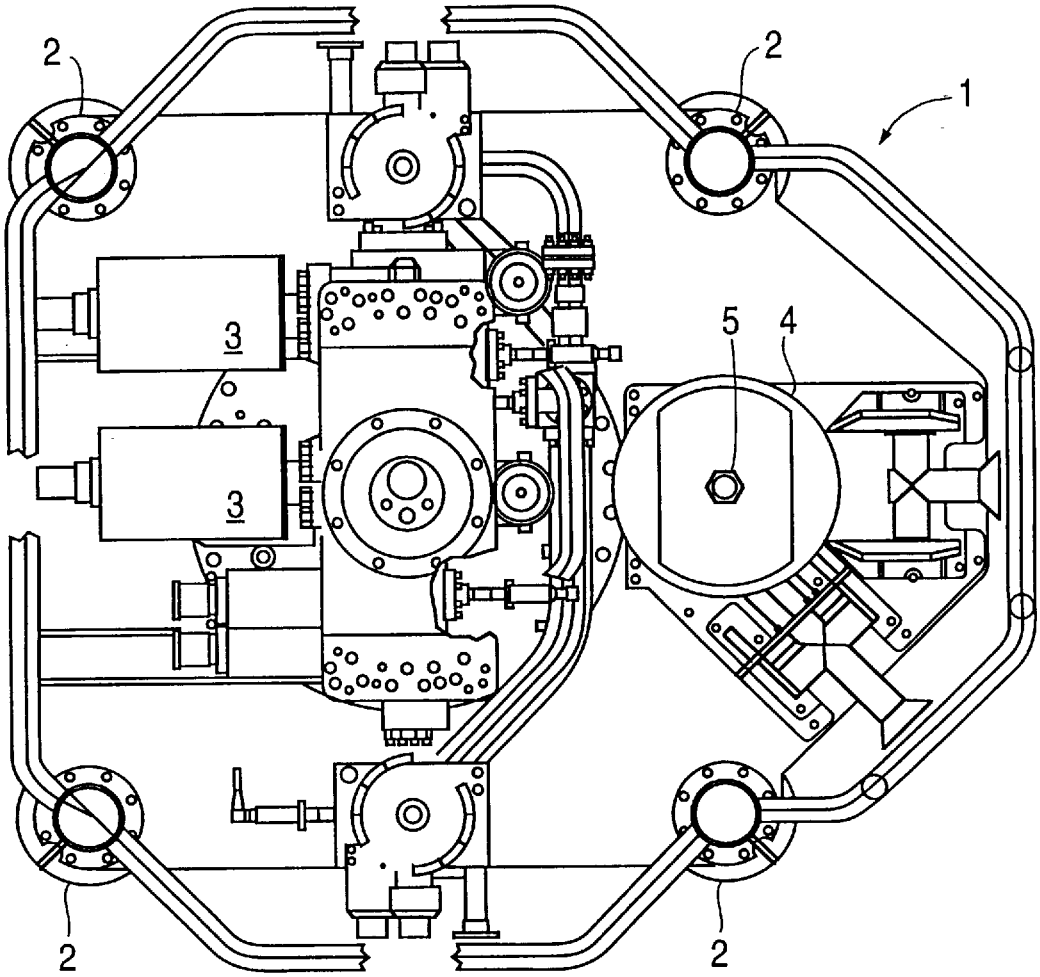
FIG. 2 is a plan view of FIG. 1.

FIGS. 1 and 2

FIGS. 1 and 2 illustrate a so-called Christmas Tree 1 which in use is mounted on a sub-sea well-head by four legs 2 in known manner to enable the oil or gas below the seabed to be extracted. It includes a variety of control devices, generally indicated at 3, tailored to the particular requirements of the oil or gas field in which it is being used. The specific arrangement and design of the Christmas Tree and its controls is not relevant to the present invention and will therefore not be described in any more detail.

In order to operate the various controls, a so-called sub-sea control module (SCM) 4 is provided whose design is again tailored to the particular Christmas Tree design. The Christmas Tree would normally remain on the well-head once installed there but the SCM 4 is adapted to be releasably mounted on the Christmas Tree. The present invention is concerned with the latching mechanism for releasably mounting the SCM 4, which is indicated generally at 5 in FIGS. 2 to 5.

Figure 3:
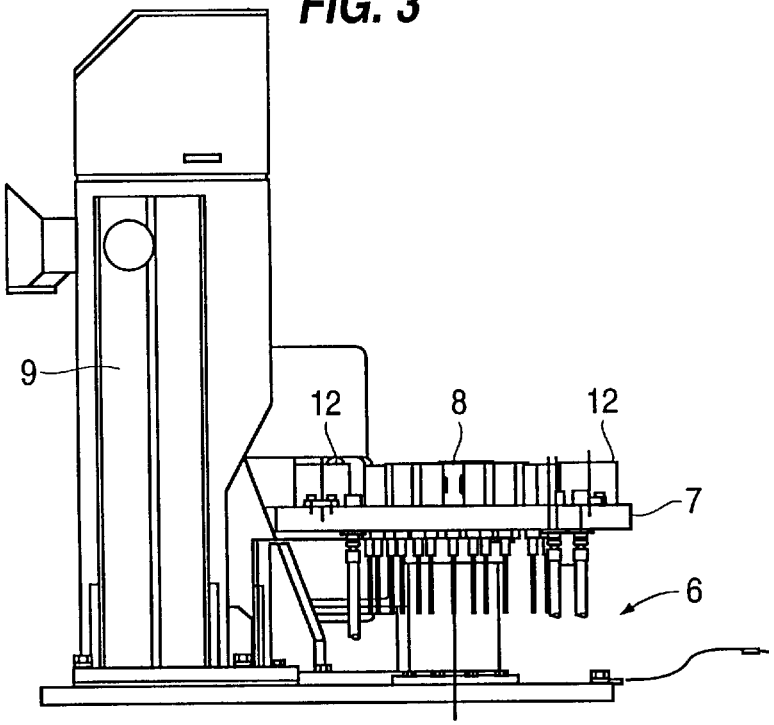
FIG. 3 is an enlarged view showing only the SCM mounting base of FIGS. 1 and 2.
Figure 4:
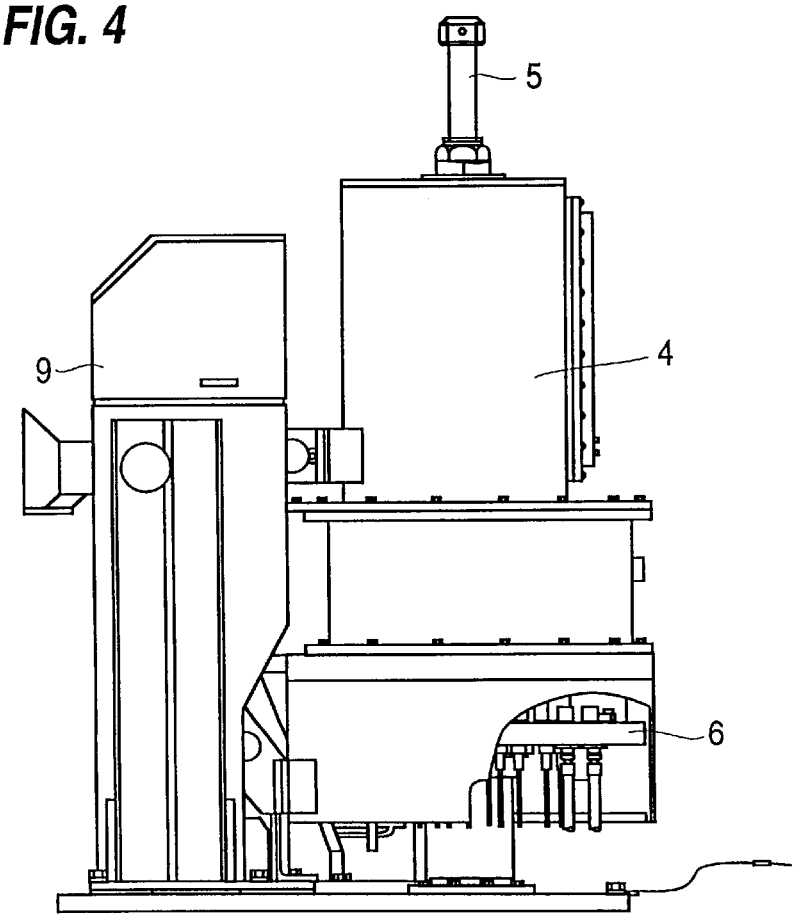
FIG. 4 is a view similar to FIG. 3 but showing the SCM in position on the mounting base.
Figure 5:
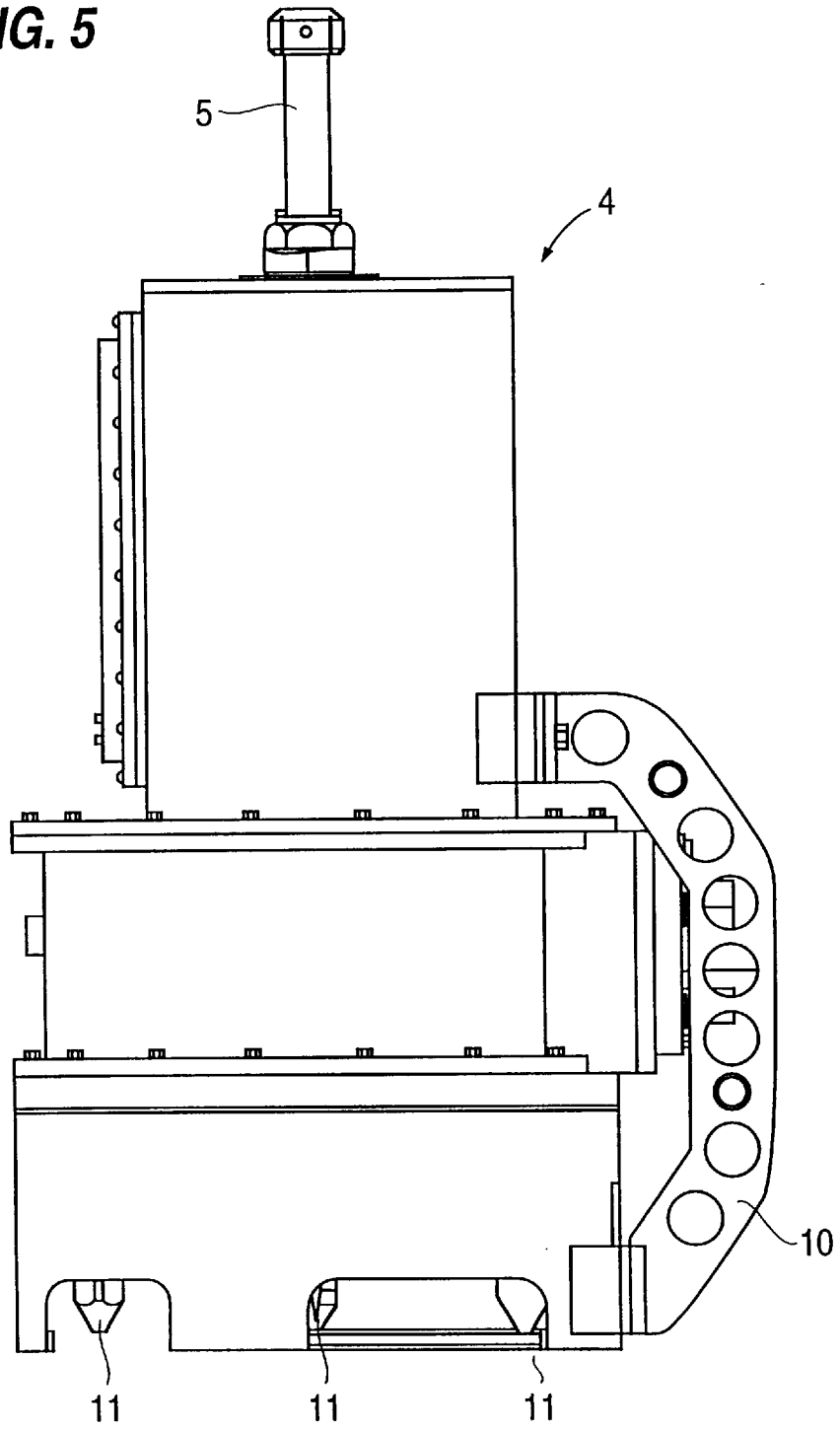
FIG. 5 is a view similar to FIG. 4, but from a different angle, illustrating the SCM and its associated crash or guide bar which is adapted to engage in a complementary guide post arrangement carried by the SCM mounting base.

FIGS. 3 to 5

FIG. 3 illustrates a base 6, which is carried by the Christmas Tree 1, upon which the SCM 4 can be detachably secured by its latching mechanism 5.

The base 6 has a platform 7 which carries hydraulic and electrical connectors, generally indicated at 8, with which cooperating connectors on the underside of the SCM 4 are adapted to engage in a known manner.

The base 6 also has an upstanding guide assembly 9 which is designed to enable the SCM 4 to be progressively guided into the correct position in relation to the platform 7 and its connectors 8 by crash bars 10 mounted on the SCM 4 (FIG. 5). The crash bars 10 engage the guide assembly 9 as the SCM 4 is lowered onto the base 6 (FIG. 4).

The SCM 4 has a number of tapered spigots 11 which are adapted to fit into cooperating sockets 12 carried by the platform 7 in order to correctly locate the SCM 4 on the base 6.

This latching mechanism will now be described in relation to FIGS. 6 to 11.

FIGS. 6 to 11

The latching mechanism 5 is mounted centrally with respect to the SCM 4 and comprises essentially a plunger 13 loaded by three coil springs 14, 15 and 16 (there could be fewer or more). The plunger 13 and springs 14, 15, and 16 are contained within a tubular housing 17.

The tubular housing 17 is closed at its top end by a threaded cap 18 which is secured to a portion 4*a* of the SCM 4.

The cap 18 carries ring seals 19 through which the upper end 13*a* of the plunger 13 is adapted to slide.

An intermediate portion of the plunger 13 carries an annular abutment 13*b* whose function is to longitudinally contain the springs 14, 15, and 16 between itself and the end cap 18.

The lower end 13*c* of the plunger 13 is tapered and is slidable within a reduced diameter portion 17*a* of the tubular housing 17. Two pairs of annular ring seals 20 and 21 are carried by the reduced diameter extension 17*a*.

The lower end of the tubular housing 17 has a shoulder 22 which is secured by bolts 23 to another portion 4*b* of the SCM 4.

A tubular cam/latch carrier 24 is threadably mounted on the reduced diameter portion 17*a* of the tubular housing 17.

Three cams 25, 26 and 27 are each pivotally mounted at 28 to the latch/cam carrier 24.

Each of the three cams 25,26 and 27 is formed with a first latch portion and a second latch portion. The first latch protion 25*a* and the second latch portion 25*b* of the cam 25 are illustrated FIGS. 6, 8, and 10.

The lowermost end of the tapered portion 13*c* of the plunger 13 is formed with an annular recess or groove 29 into which the first latch portions of the three cams 25, 26, and 27 are adapted to engage.

The way in which the latching mechanism operates will now be described.

Firstly consider the position of the latching mechanism in the situation where the SCM 4 is hanging freely, and the weight of the SCM 4 is not resting on the mounting base 6.

Figure 6:
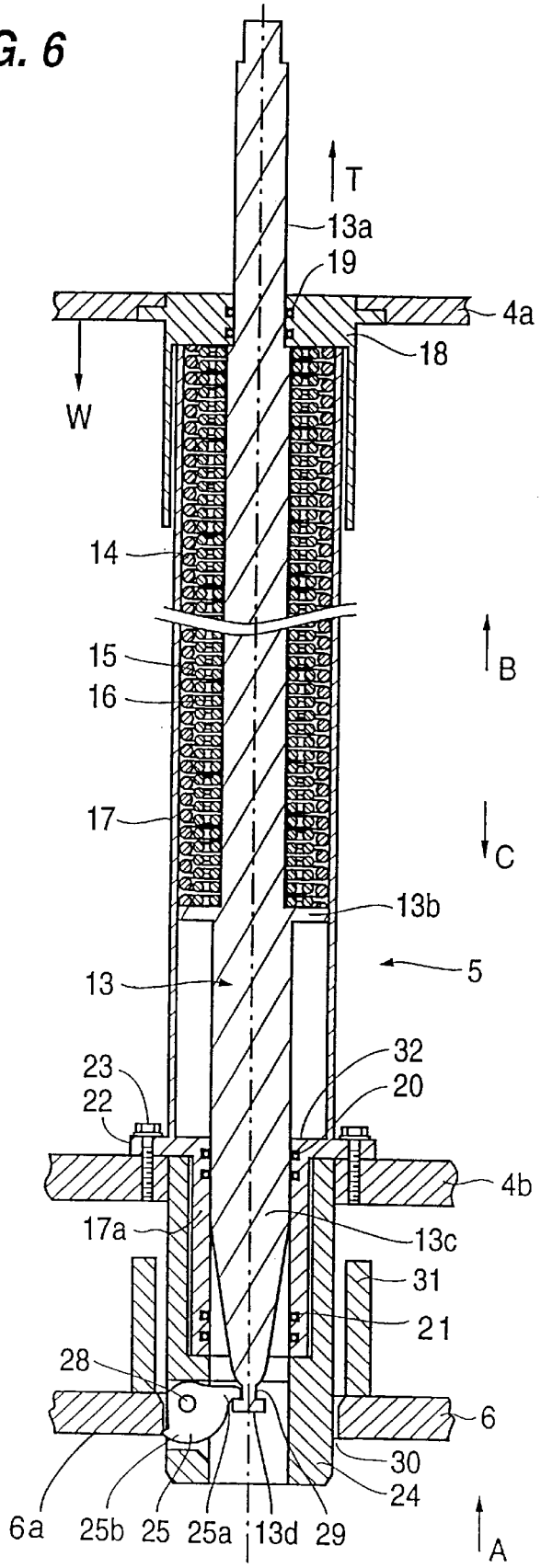
FIG. 6 is a longitudinal cross-sectional view of one construction of an SCM latch mechanism according to the present invention.

In this freely hanging position, the weight of the control pod, shown as W in FIG. 6, will be acting downwardly in the direction indicated and the equivalent tension T in the supporting cable(s) will be acting upwardly as indicated by the arrow in FIG. 6.

The effect of these forces will be to cause the springs 14, 15 and 16 to be compressed between the end cap 18 and the flange 13*b*.

This situation is illustrated in FIG. 6.

Figure 7:
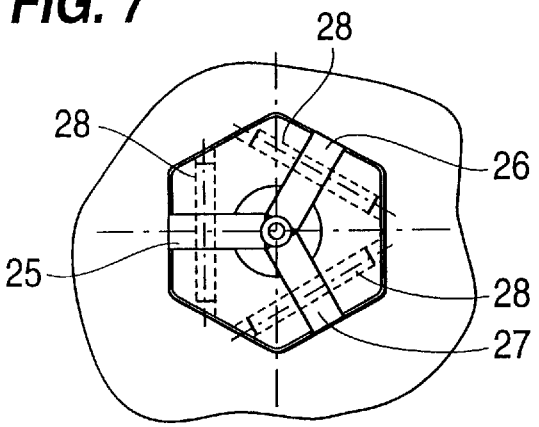
FIG. 7 is a view taken in the direction of the arrow A in FIG. 6, showing the latch mechanism in its cocked position.
Figure 9:
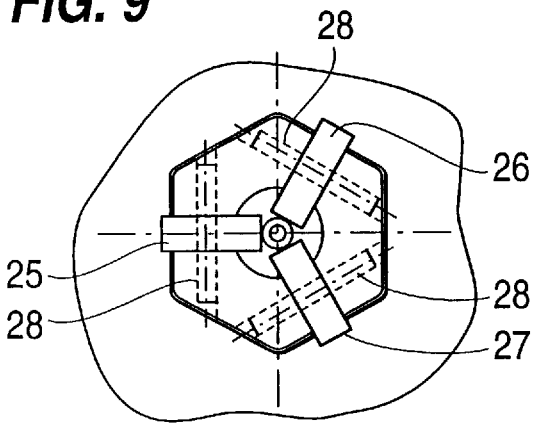
FIGS. 8 and 9 are views similar to FIGS. 6 and 7 but showing the latch mechanism in an intermediate position after initial contact between the control pod and the mounting base.

In this situation the grooved lower end 29 of the tapered portion 13*c* of the plunger 13 is in the position shown in FIG. 6 with the result that the three cams 25, 26 and 27 are in pivotal positions such that the second latch portions are withdrawn into their radially innermost positions in relation to the centre line of the plunger 13, as shown in FIGS. 6 and 7.

Now consider the position as the SCM 4 is lowered onto the mounting base 6.

The mounting base 6 is provided with a central aperture 30 which has associated with it an upstanding guide member 31.

Figure 8:
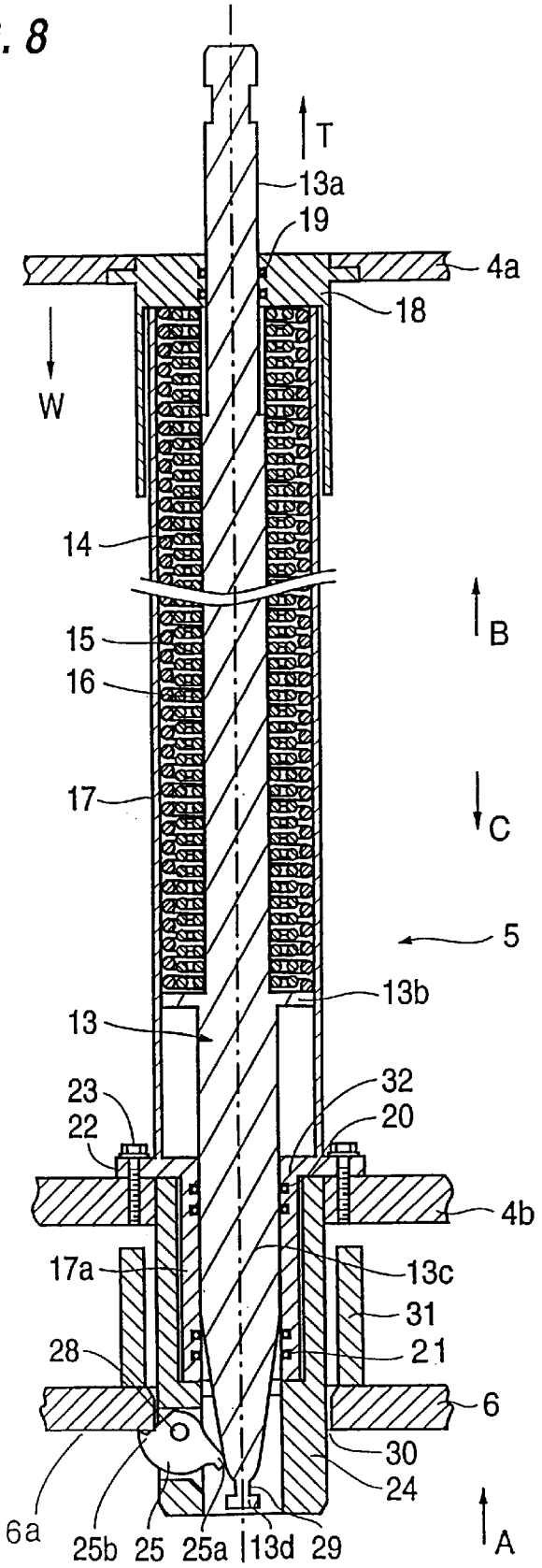

As the SCM 4 is lowered, the tubular carrier 24 enters the guide 31 and then the aperture 30 in the mounting base 6, this position also being shown in FIG. 8.

In this position, as indicated earlier, the latch cams 25, 26 and 27 are in their radially withdrawn position, as shown in FIG. 7.

Further lowering of the SCM 4, in relation to the mounting base 6, will bring the portion 4*b* of the SCM 4 into abutment with the upper edge of the guide 31, as shown in FIG. 8.

As soon as the portion 4*b* of the SCM 4 abuts the annular guide 31 of the mounting base 6, the weight of the SCM 4 will start to be taken by the mounting base 6.

The effect of this will be to reduce the forces tending to compress the coil springs 14, 15 and 16 so that the energy stored in these compressed springs will then progressively be released as they drive down the plunger 13, in relation to the mounting base 6.

Figure 10:
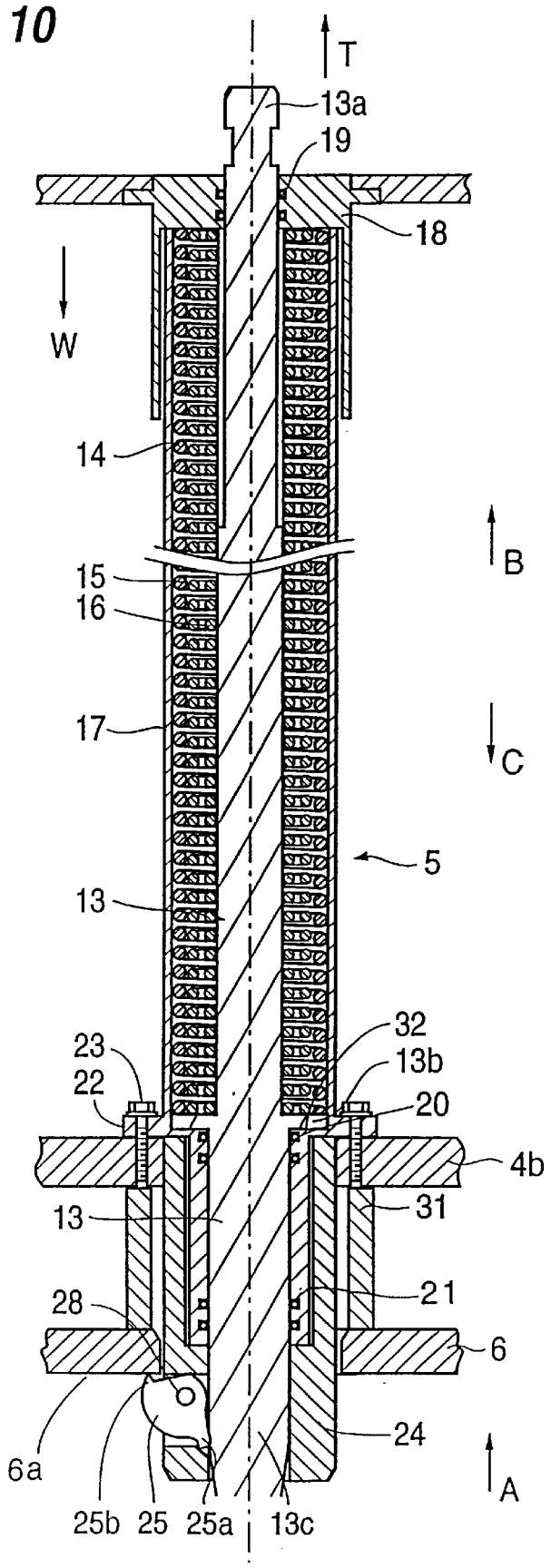

FIG. 8 shows the position shortly before the portion 4*b* of the SCM 4 has contacted the upper edge of the guide 31 on the mounting base 6, and FIG. 10 illustrates the final downward position of the plunger 13 in relation to the tubular housing 17 and the mounting base 6.

As the plunger 13 is driven down by the compressed coil springs 14, 15 and 16, the lower end surface 13*c* of the plunger 13 causes each of the first and second latch protion of the three cams 25, 26 and 27 to rotate clockwise about their respective pivots 28, as illustrated in FIGS. 8 and 10. The first latch portion 25*a* and the second latch protion 25*b* of the cam 25 in these positions are illustrated in FIGS. 8 and 10.

The effect of this clockwise rotation of the latch cams is to cause the second latch portions of the three cams to be moved radially outwardly in order to engage the underside of the portion 6*a* of the mounting base 6. This rotation also has the effect of drawing the SCM 4 of the sub-sea control pod further down onto the mounting base 6.

Figure 11:
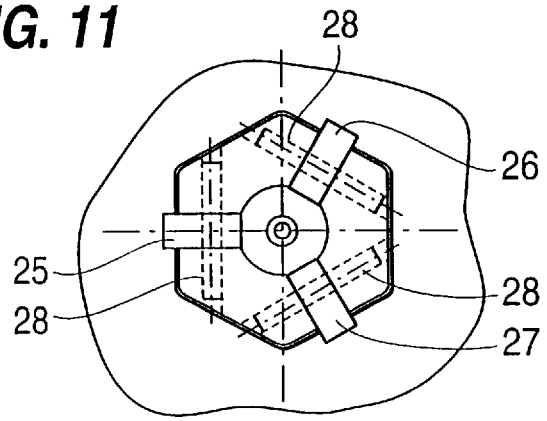
FIGS. 10 and 11 are views similar to FIGS. 6 and 7 but showing the latch mechanism in its fully engaged position.

The fully engaged position for the three cams latches 25, 26 and 27 is shown in FIGS. 10 and 11. The compressed coil springs 14, 15 and 16 have extended to their maximum possible length within the constraints of the tube 17, the threaded cap 18 and the end stop 32. Thus, the latching of the SCM 4 to the mounting base 6 is achieved automatically by virtue of the stored energy contained within the latching mechanism itself. This contrasts with the prior art arrangements which employ means external to the latching mechanism for providing the motive force for effecting the latching and unlatching operations.

In order to release the latching mechanism from engagement with the mounting base 6 (i.e. the position shown in FIGS. 10 and 11), the SCM 4 is simply raised by pulling on the lifting cable(s) (not shown) which in turn causes the plunger 13 to be lifted upwardly, as illustrated in FIGS. 6, 8 and 10.

This upward movement, in relation to the situation illustrated in FIG. 10, will cause the annular abutment 13*b* of the plunger 13 to progressively compress the coil springs 14, 15 and 16 and also allow the three latch cams 25, 26 and 27 to rotate in a counterclockwise direction about their respective pivots 28 as the tapered portion 13*c* moves past the first latch portions of the latch cams 25, 26 and 27. It should be noted that there is no requirement to have these cams spring loaded so that they will rotate in a counterclockwise direction because as the latching arrangement reaches the position shown in FIG. 8 and then in FIG. 6, the annular groove 29 and in particular an end button 13*d* will, by virtue of engagement with the first latched portions, cause the respective cams 25, 26 and 27 to rotate in a counterclockwise direction about their respective pivots 28 in order to bring the latch cams 25, 26 and 27 into the radially withdrawn position shown in FIGS. 6 and 7.

Thus, the essence of the present invention lies in providing the latching mechanism with means for storing energy within the mechanism itself, such energy being derived from the weight of the SCM.

Although the preferred embodiment of the invention employs coil springs, as described above and shown in the drawings, other means for storing such energy could also be employed while still giving the advantage of the present invention which is to eliminate the necessity for having separate motive power for operating the latch mechanism as such.

This in turn results in a significant cost saving in relation to the manufacture of the latch mechanism and makes the latter quicker acting.

What is claimed is:

1. A latching mechanism for releasably engaging a sub-sea control module to a mounting base, comprising:

a latch operably arranged to move between latched and unlatched conditions such that said sub-sea control module is releasably engaged to said mounting base; and an energy storing means operably arranged to cock said latch into said unlatched condition and to store energy in said energy storing means while said sub-sea control module is not engaged with said mounting base, said energy storing means is further operably arranged to move said latch into said latched condition and to release said stored energy in said energy storing means when said sub-sea control module engages said mounting base.

2. A latching mechanism as claimed in claim 1, wherein said latch and said energy storing means are carried by said sub-sea control module.

3. A latching mechanism as claimed in claim 1, wherein said energy is stored in said energy storing means when the weight of said sub-sea control module is transferred from said mounting base to said energy storing means when said sub-sea control module is disengaged from said mounting base.

4. A latching mechanism as claimed in claim 3, wherein said energy is released from said energy storing means when the weight of said sub-sea control module is transferred from said energy storing means to said mounting base when said sub-sea control module engages said mounting base.

5. A latching mechanism as claimed in claim 1, wherein said energy storing means comprises at least one spring operably arranged to move a plunger which is operably arranged to move said latch between said latched and unlatched conditions.

6. A latching mechanism as claimed in claim 5, wherein said latch comprises at least one cam, each cam being pivotally mounted and having a camming surface defined thereon, and said plunger has cooperating camming surfaces operably to engage said camming surface of said at least one cam and move each cam between latched and unlatched conditions.

7. A latching mechanism as claimed in claim 6, wherein said at least one cam is radially mounted about said plunger and arranged to radially extend between latched and unlatched conditions such that in the unlatched condition said at least one cam is positioned to pass through an aperature in said mounting base and in the latched condition said cams are positioned to engage an undersurface of said mounting base.

8. A latching mechanism as claimed in claim 6, wherein said plunger comprises an annular groove operably arranged to engage and retain said at least one cam in said unlatched condition when said sub-sea control module is disengaged from said mounting base.

9. A latching mechanism for releasably attaching a sub-sea control module to a mounting base, comprising:

a tubular member having upper and lower end portions secured to the sub-sea control module;

a plunger slidably mounted within apertures in the upper and lower end portions of said tubular member, said plunger having an annular abutment and a lower part extending below said abutment;

an energy storage device positioned within said tubular member between the upper end portion of said tubular member and said annular abutment, said energy storage device having a stored energy state when said annular abutment is not in contact with the lower end portion of said tubular member and a released energy state when said annular abutment has been moved into contact with the lower end portion of said tubular member; and a cam pivotally mounted on said tubular member adjacent the lower end portion thereof, said cam engaging the mounting base when said annular abutment has been moved into contact with the lower end portion of said tubular member.

10. A latching mechanism as in claim 9, wherein the energy storage device comprises at least one spring.

11. A latching mechanism as in claim 10, wherein the at least one spring is compressed during the stored energy state and uncompressed during the released energy state.

12. A latching mechanism as in claim 9, wherein the weight of said sub-sea control module transitioning from said sub-sea control module to said mounting base causes said energy storage device to transition from the stored energy state to the released energy state, and wherein the weight of said sub-sea control module transitioning from said mounting base to said sub-sea control module causes said energy storage device to transition from the released energy state to the stored energy state.

13. A latching mechanism as in claim 9, wherein said plunger further comprises a grooved lower end, and said cam further comprises a first latch portion for engaging the grooved lower end of said plunger during the stored energy state of said energy storage device.

14. A latching mechanism as in claim 9, wherein said mounting base has an underside, and said cam further comprises a second latch portion for engaging the underside of said mounting base.

15. A latching mechanism as in claim 9, wherein said cam further comprises latched and unlatched positions, said cam pivoting from the unlatched position to the latched position when said energy storage device transitions from the stored energy state to the released energy state, and said cam pivoting from the latched position to the unlatched position when said energy storage device transitions from the released energy state to the stored energy state.

16. A latching mechanism as in claim 9, wherein said plunger has a lower tapered portion, and said cam further comprises a reciprocating portion for engaging the lower tapered portion of said plunger during the released energy state of said energy storage device.

17. A latching mechanism for releasably attaching a sub-sea control module to a mounting base, comprising:

a tubular member having upper and lower end portions secured to the sub-sea control module;

a plunger having upper and lower parts slidably mounted within apertures in the upper and lower end portions of said tubular member respectively, said plunger further having an annular abutment interposed between said upper and lower parts;

means secured to said plunger for lowering said sub-sea control module onto said mounting base and for raising said module with respect to said base;

an energy storage device positioned within said tubular member between the upper end portion of said tubular member and said annular abutment, said energy storage device having a stored energy state when said sub-sea control module is not in contact with said mounting base and a released energy state when said sub-sea control module is lowered onto said mounting base, the release of energy from said energy storage device driving said plunger downward toward said mounting base; and at least one cam mounted on said tubular member adjacent the lower end portion thereof, said one cam being displaced by said plunger as said plunger moves downward toward said mounting base thereby attaching said sub-sea control module to said base.

18. A latching mechanism as claimed in claim 17 wherein said energy storage device comprises at least one coil spring.

19. A latching mechanism as claimed in claim 17 wherein said at least one cam comprises a plurality of cams pivotally mounted on said tubular member, said plurality of cams being symmetrically positioned about said plunger for actuation thereby.

20. A latching mechanism as claimed in claim 19 wherein three cams are pivotally mounted on said tubular member.

* * * * *